US011383294B2

(12) United States Patent
Li et al.

(10) Patent No.: US 11,383,294 B2
(45) Date of Patent: Jul. 12, 2022

(54) SIDE MOLD AND LOW-PRESSURE HUB CASTING MOLD

(71) Applicant: CITIC Dicastal Co., Ltd., Qinhuangdao (CN)

(72) Inventors: Zhen Li, Qinhuangdao (CN); Zuo Xu, Qinhuangdao (CN); Hanqi Wu, Qinhuangdao (CN); Zhihua Zhu, Qinhuangdao (CN); Guoyuan Xiong, Qinhuangdao (CN)

(73) Assignee: CITIC DICASTAL CO., LTD., Qinhuangdao (CN)

( * ) Notice: Subject to any disclaimer, the term of this patent is extended or adjusted under 35 U.S.C. 154(b) by 0 days.

(21) Appl. No.: 17/367,501

(22) Filed: Jul. 5, 2021

(65) Prior Publication Data

US 2022/0040756 A1 Feb. 10, 2022

(30) Foreign Application Priority Data

Aug. 4, 2020 (CN) ..... 202010772118.1

(51) Int. Cl.

| | |
|---|---|
| ***B22D 17/22*** | (2006.01) |
| ***B22C 9/06*** | (2006.01) |
| ***B22D 18/04*** | (2006.01) |

(52) U.S. Cl.

CPC ..... *B22D 17/2218* (2013.01); *B22C 9/065* (2013.01); *B22D 18/04* (2013.01)

(58) Field of Classification Search

CPC .... B22D 17/2218; B22D 18/04; B22C 9/065; B22C 9/28

See application file for complete search history.

(56) References Cited

FOREIGN PATENT DOCUMENTS

CN 108356228 A * 8/2018 ..... B22C 9/065

* cited by examiner

*Primary Examiner* — Kevin P Kerns
*Assistant Examiner* — Steven S Ha
(74) *Attorney, Agent, or Firm* — IPro, PLLC

(57) ABSTRACT

The application belongs to the technical field of a casting mold and provides a side mold and a low-pressure hub casting mold. Channels of a cooling loop are processed in a back cavity of a side mold frame, a distance between the channels along a solidification direction of a casting gradually increases, and a cooling medium flows along the cooling loop, the ability of taking away heat changes from strong to weak, and a larger temperature gradient of the side mold may be formed by superposition with a temperature gradient formed by the thickness of the side mold.

14 Claims, 3 Drawing Sheets

SIDE MOLD AND LOW-PRESSURE HUB CASTING MOLD

TECHNICAL FIELD

The present application relates to the technical field of a casting mold, in particular to a side mold and a low-pressure hub casting mold.

BACKGROUND

When a metal hub mold is designed, it is necessary to realize reasonable sequential solidification of the whole hub casting in the solidification direction, thereby ensuring the feeding of the casting, enabling the mechanical property of the casting to meet requirements and avoiding the casting defects such as shrinkage porosity and shrinkage cavity. For the traditional hub metal mold, a temperature gradient of the side mold is mainly controlled by the thickness of the mold material. When the mold design is completed, it means that the range of the temperature gradient is basically determined and is difficult to change. Under the condition of low requirement on the casting efficiency, adjusting the solidification sequence of a rim based on the material thickness of the mold can still meet the production requirement, but long solidification time is required, which leads to low casting efficiency. However, due to the huge market demand of hubs and the increasing shortage of the production capacity, the improvement of the hub casting efficiency has become an irreversible trend in the industry. The traditional temperature gradient formed based on the thickness of the mold material has been far from meeting the production condition. Therefore, the rim area needs more effective cooling means to form a larger temperature gradient to meet the urgent need of stable mass production.

SUMMARY

Embodiments of the present application provide a side mold and a low-pressure hub casting mold, which enable a hub side mold to form a larger temperature gradient, shorten the solidification time, further improve the casting efficiency, are more beneficial to the sequential solidification of castings and the improvement of the compactness of the castings and the mechanical property, and effectively reduce the casting defects such as shrinkage porosity and shrinkage cavity.

To achieve the above objectives, the present application provides the following technical solution.

In a first aspect, a side mold is provided. The side mold includes a side mold frame, a cooling cover plate, heat-insulating gaskets, an inlet pipe and an outlet pipe, wherein a cooling loop is processed in a back cavity of the side mold frame, the cooling loop includes a plurality of substantially parallel channels, and a distance between the adjacent channels along a solidification direction of a casting gradually increases; sealing grooves are formed at the periphery of the cooling loop and between the two adjacent channels, and the heat-insulating gaskets are mounted in the sealing grooves; the cooling cover plate is fixed in the back cavity and covers the cooling loop and the heat-insulating gaskets; and the inlet pipe and the outlet pipe communicate with the channels of the cooling loop. A cooling medium flows through the cooling loop and the heat-insulating gaskets arranged in such a way to perform cooling, the cooling medium enters from the inlet pipe, flows along the cooling loop and finally flows out from the outlet pipe, the heat of the mold is taken away in the flowing process, cooling is performed again on the basis of the original temperature gradient formed due to the thickness of the side mold, a spacing distance between the channels in the cooling loop gradually increases along the solidification direction, the ability of taking away heat changes from strong to weak, and a larger temperature gradient of the side mold may be formed by superposition with a temperature gradient formed due to the thickness of the side mold; furthermore, the heat-insulating gaskets play a role in heat insulation and reduce the influence of the adjacent channels to make the temperature gradient more obvious, so that a good feeding range is formed, the compactness of the casting is improved and the excellent mechanical property of a rim part is achieved; and meanwhile, local cooling is accelerated, so that the production rhythm is accelerated and the production efficiency of the casting process is improved.

In some embodiments, the heat-insulating gaskets are one of refractory and heat-insulating materials such as graphite gaskets, ceramic gaskets, rock wool gaskets and aluminum silicate heat-insulating cotton gaskets.

In some embodiments, the cooling medium such as cooling air or cooling water is introduced into the channels of the cooling loop to cool the side mold.

In some embodiments, the inlet pipe and the outlet pipe are arranged along the solidification direction of the casting, thereby facilitating reasonable design of the channels in the cooling loop and flow circulation of the cooling medium.

In some embodiments, a bottom of the inlet pipe is blocked, and a flow dividing through hole is processed along a flowing direction of the cooling medium. The flow dividing through hole plays a role in dividing the cooling medium and enables the cooling medium to flow more uniformly along the direction of the loop.

In some embodiments, the cooling loop is divided into left and right parts, the cooling medium is divided into left and right streams by the inlet pipe, and the left and right streams of cooling mediums flow along the channels and are converged at the outlet pipe. Due to such a cooling loop divided into two parts, the cooling medium flows more uniformly and the cooling effect is better.

In some embodiments, a cooling insert is fixed below the cooling cover plate in the back cavity of the side mold frame, a cooling channel may be formed in the cooling insert, the cooling medium flows in the cooling channel, and the cooling insert locally cools a thicker part of the casting, so that the problem that heat conduction and heat dissipation are not obvious when the joint of the rim and a spoke is locally cooled is solved.

In a second aspect, an embodiment of the present application provides a low-pressure hub casting mold, including a top mold and a bottom mold and further including at least one side mold in any one of the above embodiments, wherein a mold cavity for low-pressure casting is formed by surrounding of the top mold, the bottom mold and the at least one side mold. By adoption of the integrated or separated side mold in the above embodiments, cooling is performed again on the basis of the original temperature gradient formed due to the thickness of the side mold, the spacing distance between the channels in the cooling loop gradually increases along the solidification direction, the ability of taking away heat changes from strong to weak, and a larger temperature gradient of the side mold may be formed by superposition with the temperature gradient formed by the thickness of the side mold, so that a good feeding range is formed and the compactness of the casting is improved, thereby achieving excellent mechanical property of the rim part; and meanwhile, local cooling is accelerated, so that the production rhythm is accelerated and the production efficiency of the process is improved.

Compared with the prior art, the present application has the following beneficial effects:

the present application provides the side mold and the low-pressure hub casting mold, wherein the plurality of channels of the cooling loop are processed in the back cavity of the side mold frame, the distance between the adjacent channels gradually increases along the solidification direction of the casting, the cooling medium enters from the inlet pipe, flows along the cooling loop and finally flows out from the outlet pipe, the heat of the mold is taken away in the flowing process, cooling is performed on the basis of the original temperature gradient formed by the thickness of the side mold, the spacing distance between the channels in the cooling loop gradually increases along the solidification direction, the ability of taking away heat changes from strong to weak, and the larger temperature gradient of the side mold may formed by superposition with the temperature gradient formed by the thickness of the side mold; furthermore, the heat-insulating gaskets play a role in heat insulation and reduce the influence of the adjacent channels to make the temperature gradient more obvious, so that a good feeding range is formed, the compactness of the casting is improved and the excellent mechanical property of the rim part is achieved; and meanwhile, local cooling is accelerated, so that the production rhythm is accelerated and the production efficiency of the casting process is improved.

Figure 1:
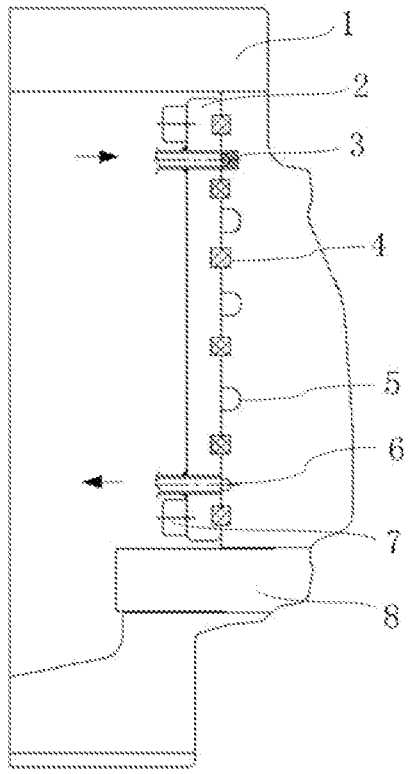
FIG. 1 is a section view of a side mold of the present application.

In the drawings: 1—side mold frame, 2—cooling cover plate, 3—inlet pipe, 4—heat-insulating gasket, 5—channel, 6—outlet pipe, 7—bolt, 8—cooling insert, 9—inlet pipe positioning hole, 10—cooling cover plate inlet, 11—cooling cover plate gasket pressure groove, 12—cooling cover plate outlet, 13—cooling cover plate bolt through hole, 14—flow dividing through hole, 15—side mold.

DETAILED DESCRIPTION

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

In combination with FIG. 1 to FIG. 5 of the specification, the embodiment 1 provides a side mold. As shown in the section view in FIG. 1, the side mold includes a side mold frame 1, a cooling cover plate 2, an inlet pipe 3, an outlet pipe 6, heat-insulating gaskets 4, channels 5 and a cooling insert 8. The side mold frame 1 adopts casting mold steel, a cooling loop is processed in a back cavity of the side mold frame 1, the cooling loop includes a plurality of substantially parallel channels 5, and a distance between the adjacent channels 5 along a solidification direction of a casting gradually increases. The channels 5 are arc-shaped grooves along the circumference of the side mold, and a distance between the adjacent arc-shaped grooves along the solidification direction of the casting (for example, a solidification direction of a rim, from top to bottom) gradually increases.

Figure 3:
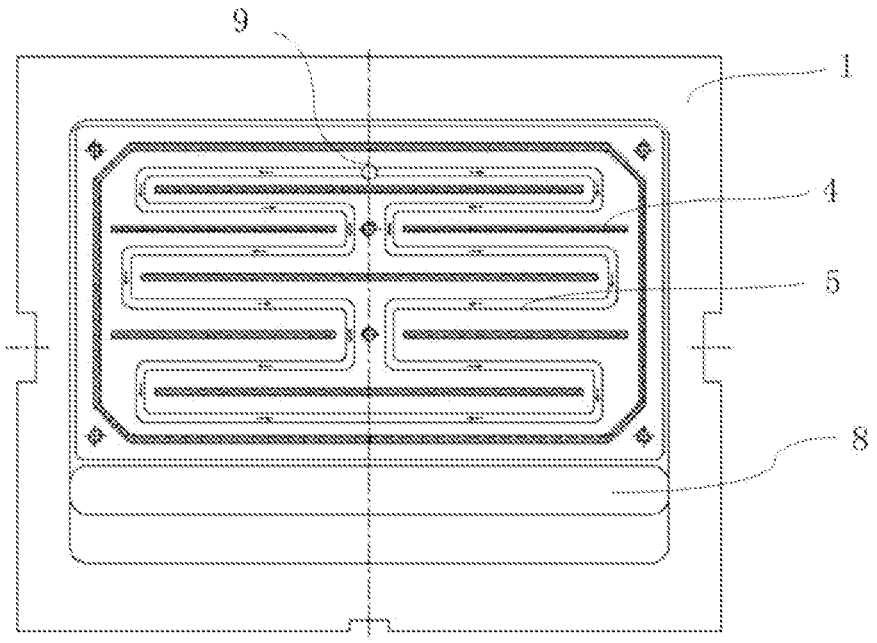
FIG. 3 is a side view of a side mold frame of a side mold of the present application.
Figure 4:
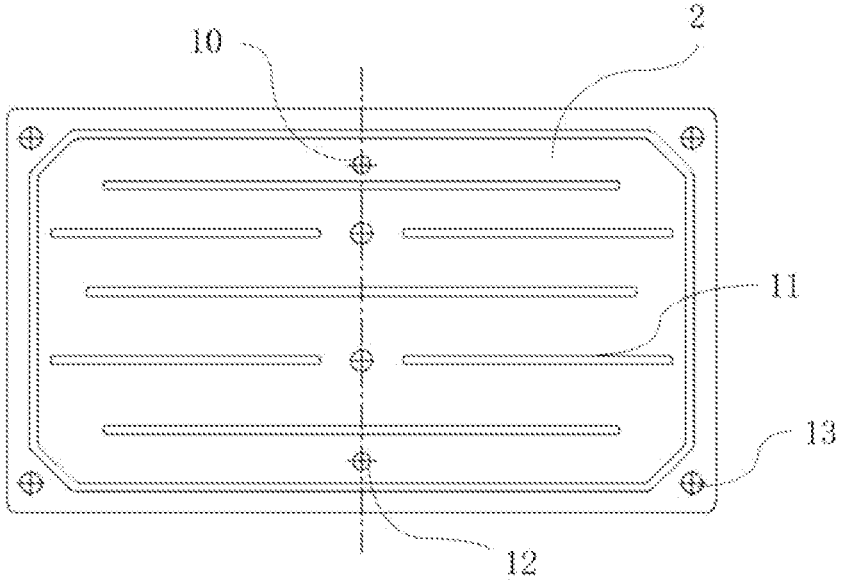
FIG. 4 is a side view of a cooling cover plate of a side mold of the present application.

As shown in FIG. 3, sealing grooves are formed at the periphery of the cooling loop and between the two adjacent channels 5 in the cooling loop along the solidification direction of the casting, and the heat-insulating gaskets 4 are mounted in the sealing grooves, so that the heat-insulating gaskets 4 play a role in heat insulation, and reduce the influence between the adjacent arc-shaped grooves or channels to make a temperature gradient more obviously. The heat-insulating gaskets 4 are one of refractory and heat-insulating materials such as graphite gaskets, ceramic gaskets, rock wool gaskets and aluminum silicate heat-insulating cotton gaskets.

Figure 2:
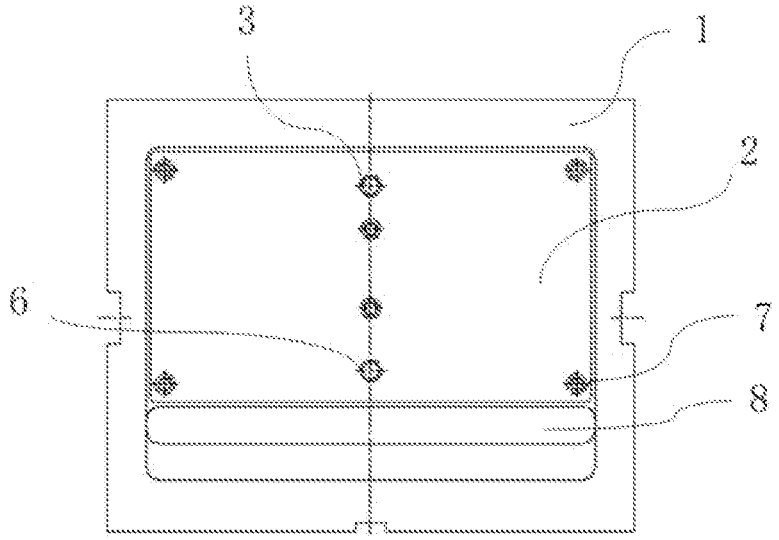
FIG. 2 is a side view of a side mold of the present application.

As shown in FIG. 2, the cooling cover plate 2 is fixed in the back cavity and covers the cooling loop and the heat-insulating gaskets 4, the inlet pipe 3 and the outlet pipe 6 which communicate with the channels 5 of the cooling loop are arranged on the cooling cover plate 2, and the inlet pipe 3 and the outlet pipe 6 are arranged along the solidification direction of the casting. The cooling medium such as cooling air or cooling water is introduced into the channels 5 of the cooling loop.

Figure 5:
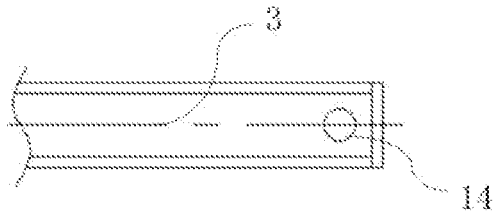
FIG. 5 is a structural schematic diagram of an inlet pipe of a side mold of the present application.

As shown in FIG. 3, the cooling loop is divided into left and right parts, the cooling medium is divided into left and right streams by the inlet pipe 3, and the left and right streams of cooling mediums flow along the channels and are converged at the outlet pipe 6. As shown in FIG. 5, a bottom of the inlet pipe 3 is blocked, and a flow dividing through hole 14 is processed along a flowing direction of the cooling medium, so that the cooling medium flows and disperses uniformly towards a designed direction to achieve the flow stabilizing effect.

A cooling insert 8 is fixed below the cooling cover plate 2 in the back cavity of the side mold frame 1, a cooling channel may be formed in the cooling insert 8, the cooling medium flows in the cooling channel, and the cooling insert 8 locally cools a thicker part of the casting, so that the problem that heat conduction and heat dissipation are not obvious when the joint of the rim and a spoke is locally cooled is solved.

In actual production and use, the back cavity of the side mold frame 1 is processed first, the channels 5 of the cooling loop are processed in the back cavity of the side mold frame 1, a plane matched with the cooling cover plate 2 is processed, and then the channels of the cooling loop, accommodating grooves of the heat-insulating gaskets, an engaging bolt threaded hole and an inlet pipe positioning hole 9 are processed. Then, the customized heat-insulating gaskets 4 such as graphite gaskets are put into the accommodating grooves of the heat-insulating gaskets of the side mold frame 1. Subsequently, the cooling cover plate 2, and corresponding cooling cover inlet 10, cooling cover plate outlet 12, cooling cover plate gasket pressure grooves 11 and cooling cover plate bolt through holes 13 are processed, and the inlet pipe 3 and the outlet pipe 6 are positioned on the cooling cover plate 2 and are sealed and fixed through welding. When the inlet pipe is welded, the inlet pipe flow dividing through hole needs to rightly face the direction of the loop, so that the cooling medium flows and disperses uniformly towards the designed direction, thereby achieving the flow stabilizing effect. Finally, the processed side mold frame 1 and the cooling cover plate 2 are assembled, and are fixed through six bolts 7 as shown in FIG. 2 and FIG. 3.

During on-site casting production, the cooling medium enters through the inlet (as shown in FIG. 1), flows along the direction of the cooling loop (as shown in FIG. 3) and flows out from the outlet, the heat of the mold is taken away, a temperature gradient is formed through the first-in-last-out sequence of the cooling medium, and the flow of the cooling medium is controlled by adjusting the output pressure of the cooling medium so as to adjust the overall temperature and the temperature gradient of the side mold.

In the embodiment 1, the channels of the cooling loop and the heat-insulating gaskets are arranged in the side mold, the cooling medium flows through the cooling loop to perform cooling, the cooling medium enters from the inlet pipe, flows along the cooling loop and finally flows out from the outlet pipe, the heat of the mold is taken away in the flowing process, cooling is performed again on the basis of the original temperature gradient formed due to the thickness of the side mold, the spacing distance between the arc-shaped grooves or channels in the cooling loop gradually increases along the solidification direction, the ability of taking way heat changes from strong to weak, and a larger temperature gradient may be formed by superposition with the temperature gradient formed by the thickness of the side mold; furthermore, the heat-insulating gaskets play a role in heat insulation and reduce the influence of the adjacent channels to make the temperature gradient more obviously, so that a good feeding range is formed, the compactness of the casting is improved and excellent mechanical property of the rim part is achieved; and meanwhile, local cooling is accelerated, so that the production rhythm is accelerated and the production efficiency of the casting process is improved.

After the actual on-site production test, compared with the traditional side mold of the same product, the novel side mold structure has very obvious advantages in terms of the temperature, the temperature gradient, the production efficiency, the tensile strength of the casting rim and the coefficient of elongation of the casting rim. The comparison is shown in Table 1 below.

Table 1 The actual production comparison result of the traditional side mold and the novel side mold of the present application.

| Type of side mold | Highest temperature of side mold | Temperature gradient of side mold | Stable production efficiency | Tensile strength of casting rim | Coefficient of elongation of casting rim |
|---|---|---|---|---|---|
| Traditional side mold | 512° C. | 21° C. | 11 pieces/hour | 224 Mpa | 2.7% |
| Novel side mold | 478° C. | 45° C. | 16 pieces/hour | 251 Mpa | 4.1% |

Embodiment 2

Figure 6:
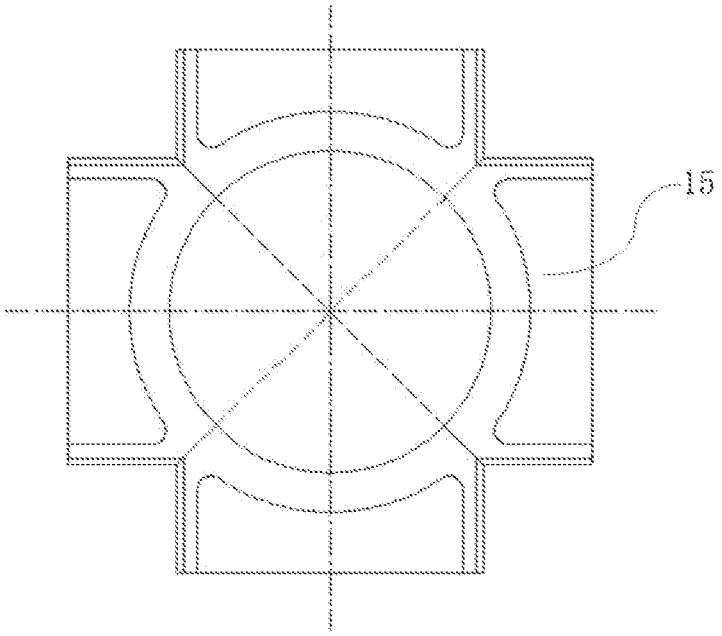
FIG. 6 is a schematic diagram of a combination of a side mold of a low-pressure hub casting mold of the present application.

The embodiment 2 of the present application provides a low-pressure hub casting mold, including a top mold, a bottom mold and four side molds 15 as defined in any one of the above embodiments, wherein a mold cavity subjected to low-pressure casting is formed by surrounding of the top mold, the bottom mold and the four side molds 15. The combined structure of the side molds 15 is shown in FIG. 6. In other embodiments, according to the requirements of a casting product, the side mold structure may be integral or a combination of more than one separated blocks.

In the embodiment 2, by adoption of the side mold in the above embodiments, cooling is performed again on the basis of the original temperature gradient formed due to the thickness of the side mold, the spacing distance between the arc-shaped grooves or channels in the cooling loop gradually increases along the solidification direction, the ability of taking away heat changes from strong to weak, and a larger temperature gradient may be formed by superposition with the temperature gradient formed by the thickness of the side mold; furthermore, the heat-insulating gaskets play a role in heat insulation and reduce the influence of the adjacent channels to make the temperature gradient more obviously, so that a good feeding range is formed, the compactness of the casting is improved, and excellent mechanical property of the rim part is achieved; and meanwhile, local cooling is accelerated, so that the production rhythm is accelerated, and the production efficiency of the casting process is improved.

What is claimed is:

1. A side mold, comprising a side mold frame, a cooling cover plate, heat-insulating gaskets, an inlet pipe and an outlet pipe, wherein a cooling loop is processed in a back cavity of the side mold frame, the cooling loop comprises a plurality of substantially parallel channels, and a distance between adjacent channels along a solidification direction of a casting gradually increases;

sealing grooves are formed at the periphery of the cooling loop and between the adjacent channels, and the heat-insulating gaskets are mounted in the sealing grooves;

the cooling cover plate is fixed in the back cavity and covers the cooling loop and the heat-insulating gaskets; and the inlet pipe and the outlet pipe communicate with the channels of the cooling loop.

2. The side mold according to claim 1, wherein the heat-insulating gaskets are one of graphite gaskets, ceramic gaskets, rock wool gaskets and aluminum silicate heat-insulating cotton gaskets.

3. A low-pressure hub casting mold, comprising a top mold and a bottom mold and further comprising at least one side mold of claim 2, wherein a mold cavity subjected to low-pressure casting is formed by surrounding of the top mold, the bottom mold and the at least one side mold.

4. The side mold according to claim 1, wherein cooling air or cooling water are introduced into the channels of the cooling loop.

5. A low-pressure hub casting mold, comprising a top mold and a bottom mold and further comprising at least one side mold of any claim 4, wherein a mold cavity subjected to low-pressure casting is formed by surrounding of the top mold, the bottom mold and the at least one side mold.

6. The side mold according to claim 1, wherein the inlet pipe and the outlet pipe are arranged along the solidification direction of the casting.

7. A low-pressure hub casting mold, comprising a top mold and a bottom mold and further comprising at least one side mold of claim 6, wherein a mold cavity subjected to low-pressure casting is formed by surrounding of the top mold, the bottom mold and the at least one side mold.

8. The side mold according to claim 1, wherein a bottom of the inlet pipe is blocked, and a flow dividing through hole is processed along a flowing direction of a cooling medium.

9. The side mold according to claim 8, wherein the cooling loop is divided into left and right parts, the cooling medium is divided into left and right streams by the inlet pipe, and the left and right streams of cooling mediums flow along the channels and are converged at the outlet pipe.

10. A low-pressure hub casting mold, comprising a top mold and a bottom mold and further comprising at least one side mold of claim 9, wherein a mold cavity subjected to low-pressure casting is formed by surrounding of the top mold, the bottom mold and the at least one side mold.

11. A low-pressure hub casting mold, comprising a top mold and a bottom mold and further comprising at least one side mold of claim 8, wherein a mold cavity subjected to low-pressure casting is formed by surrounding of the top mold, the bottom mold and the at least one side mold.

12. The side mold according to claim 1, wherein a cooling insert is fixed below the cooling cover plate in the back cavity of the side mold frame.

13. A low-pressure hub casting mold, comprising a top mold and a bottom mold and further comprising at least one side mold of claim 12, wherein a mold cavity subjected to low-pressure casting is formed by surrounding of the top mold, the bottom mold and the at least one side mold.

14. A low-pressure hub casting mold, comprising a top mold and a bottom mold and further comprising at least one side mold of claim 1, wherein a mold cavity subjected to low-pressure casting is formed by surrounding of the top mold, the bottom mold and the at least one side mold.

* * * * *